United States Patent [19]

Etienne

[11] 4,073,332

[45] Feb. 14, 1978

[54] METHOD OF CONTROLLING CONTINUOUS CASTING OF A METAL

[75] Inventor: Arlette Thérèse Etienne, Boncelles, Belgium

[73] Assignee: Centre de Recherches Metallurgiques Centrum Voor Research in de Metallurgie, Brussels, Belgium

[21] Appl. No.: 615,846

[22] Filed: Sept. 23, 1975

[30] Foreign Application Priority Data

| | | |
|---|---|---|
| Sept. 26, 1974 | Belgium | 820408 |
| Oct. 9, 1974 | Belgium | 820889 |
| Mar. 21, 1975 | Belgium | 827040 |
| Apr. 13, 1975 | Luxembourg | 72732 |

[51] Int. Cl.[2] ..... B22D 11/16

[52] U.S. Cl. ..... 164/4; 164/89

[58] Field of Search ..... 164/4, 89, 154

[56] References Cited

U.S. PATENT DOCUMENTS

| | | | |
|---|---|---|---|
| 3,478,808 | 11/1969 | Adams | 164/4 |
| 3,583,467 | 6/1971 | Bennett | 164/4 |
| 3,759,309 | 9/1973 | Nighman | 164/89 |
| 3,915,216 | 10/1975 | Fekete et al. | 164/89 |

*Primary Examiner*—Gil Weidenfeld

*Attorney, Agent, or Firm*—Holman & Stern

[57] ABSTRACT

A metal strand is cast by a continuous casting machine. The strand passes through a series of secondary cooling zones. The rate at which coolant is supplied to each zone is varied by means of valves which are controlled in accordance with the casting speed so as to maintain a desired thermal profile for the temperature along the surface of the strand.

6 Claims, 4 Drawing Figures

METHOD OF CONTROLLING CONTINUOUS CASTING OF A METAL

The present invention relates to a method of controlling the continuous casting of a metal.

The following text is concerned mainly with the continuous casting of steel, but it will be understood that the same considerations remain valid for any metal capable of being cast under the conditions defined.

The process of continuous casting consists in teeming (pouring) the molten metal from a foundry ladle directly, or through a tundish, into a water-cooled continuous-casting mould. Under the action of the so-called primary cooling in the mould, solidification of the metal is initiated and a partly solidified metal strand issues regularly from the open lower end of the mould.

The strand which is undergoing solidification as it issues continuously from the mould, is subjected to direct cooling by water. This so-called secondary cooling ensures the progressive and complete solidification of the metal.

Throughout the solidification the skin of the continuously cast steel strand is exposed to variable thermal and mechanical stresses. These stresses, in conjunction with the low mechanical strength of the product, may give rise to cracking, which induces breakouts or the appearance of internal or surface defects.

The control of the operation of a continuous casting installatin must ensure casting without mishaps (breakouts or swellings of a sound product without segregation of cracks, whether internal or superficial) in a rhythm synchronous with the tapping of the process furnaces.

This control consists in: defining the casting speed, calculating the flow rate of water to be delivered in each zone of the secondary cooling circuit.

The rules laid down by the constructors and effectively employed in most installations are relatively simple. On the one hand, a maximum casting speed is defined as a function of the composition of the metal (for instance, the grade of the steel) and of the shape of the cross section of the strand. This speed corresponds to the greatest permissible length of the liquid core. On the other hand, the total flow rate of secondary water is proportional to the casting speed. This flow rate is calculated so as to keep constant the weight of the sprayed water per kilogramme of cast metal. This weight of water is also defined as a function of the composition of the metal. In the case of teel it varies from 0.5 litre/kg to 2 litres/kg, but generally its value is close to 1 litre/kg. In addition, the distribution of the secondary water between the various spraying zones is specified by the constructors and kept fixed regardless of the casting conditions.

The results that are obtained show that these rules are incapable of keeping the surface temperature of the strand within a range of values acceptable in every case. Besides, various studies of continuously-cast products have shown that the appearance of fissures is related to either excessive local cooling or excessive variations in surface temperature.

To sole the quality problems that may arise, the user will generally reduce the weight of secondary water per kilogramme of metal, as well as the casting speed. These measurements, which are peculiar to a given installation, result in limiting production.

The object of the present invention is to remedy the disadvantages decribed above.

The invention provides a method of controlling the continuous casting of a metal by a continuous casting machine having a liquid-cooled mould in which primary cooling of the molten metal occurs to form a metal strand having a liquid core, issuing from the mould, and passing through a series of secondary cooling zones to which a coolant is supplied through respective flow-control valves, the method comprising the steps of: determining an optimum casting speed; determining a desired thermal profile for the temperature along the surface of the strand; starting the casting machine at the optimum casting speed; measuring the casting speed, which will vary owing to changes in the rate at which molten metal enters the mould; from the desired thermal profile and the measured casting speed, determining the rate at which the coolant is to be supplied to each of the secondary cooling zones in oreder to maintain the desired thermal profile; and controlling the valves so that the coolant is supplied to each of the secondary cooling zones at the rate determined for that zone.

This method is based on the following considerations.

Contrary to the present practice, it is assumed that the flow rates of water (or other coolant) to be supplied to the different zones of secondary cooling are to be calculated from the casting speed, the size of the product, the temperature of casting, and the characteristics of the machine so as to maintain a certain thermal profile at the surface of the strand. This thermal profile depends on the composition of the metal, for instance the grade of the steel.

An important point in controlling a continuous casting machine is, therefore to have at one's disposal references (numerical tables, graphs, formulae, etc.) specifying the flow rate of secondary water as a function of the operational conditions, and more particularly of the casting speed. This speed is calculated so as to maintain synchronization with the processing furnaces, for example of the steel foundry, and to ensure a good quality product.

Another important point in controlling a continuous casting machine lies in the adaptation of the varying flowrate of secondary water to such changes of speed as will inevitably occur in the course of casting. Indeed, marked variations in the speed are often connected with changes in the ladle, changes in the tundish, or accidental obstructions in the teeming nozzle, for example. In the present system of regulation as described above, variations in speed actuate immediately and automatically variations in the delivery of water according to the basic rules. Measurements of the surface temperature of the strand carried out by means of an optical pyrometer on a slab-casting machine have established that such practice can cause strong perturbations in the surface temperature of the strand (of several hundred degrees) which endure for a relatively long time (several minutes). These perturbations arise from the fact that the flow rate of the water spray is no longer suited to the thickness of the solidified skin in the zone in question. The variations in the solidified thickness caused by speed changes attain, in fact, stationary values after a response time which varies along the machine. In order to avoid these perturbations, which are sufficient to cause major defects in the cast product, it is proposed that the variations in supply sould be calculted as a function of the instantaneous solidified thickness arising from changes of speed.

The totality of the calculations and control steps needed to keep a thermal profile constant along the machine in most cases cannot be carried out by the efforts of a single operator. Consequently, it is proposed to assign these tasks to a computer that would ensure the satisfactory performance of the machine (calculation of the optimum casting speed, the optimal cooling, the progression of casting in the course of time, and the secondary water flow rate) and the automatic control of the water values.

In accordance with the present invention the casting data specific to each ladle are fed into the computer, the optimum casting speed is determined, i.e. the speed that satisfies the predetermined quality requirements and maintains the synchronization with the processing furnaces, the continuous casting machine is set in operation, the casting speed is measured, from this measured value of the casting speed are calculated the flow rates of water to be supplied to the different zones of secondary cooling so as to maintain a predetermined surface thermal profile, and the positioning of the appropriate water valves is activated accordingly.

The flow rates of water to be delivered to the various zones of secondary cooling may be calculated by converting the casting speed into the time that a sector of metal takes to pass from entering the casting machine to a point characteristic of each secondary cooling zone, for example, the point of exit from the zone, and by deducting the flow rate from this time by recourse to references (e.g. numerical tables, graphs, or formulae) that establish the correspondence between these two parameters. The great interest of this lies in that the references (numerical tables, graphs, or formulae) relating the deliveries of the secondary cooling water to the time of sojourn (passage) are equally applicable to variable and steady operations.

The optimum casting speed may be determined by provisionally calculating the desired casting speed for the line, on the one hand, and the maximum casting speed, on the other hand, and choosing the slower of the two casting-speed values for operating the casting machine.

The maximum casting speed should preferably be calculated so as to satisfy the quality requirements based on a maximum length of the liquid core to avoid such defects as segregation and swelling, taking into account a surface thermal profile which has been determined in advance for avoiding such defects as cracks, fissures, etc.

Preferably, the specific data of casting for each ladle fed to the computer are: the weight of the metal in the ladle, the desired casting time, the number of service lines, the shape of the cross section of the strand per line, the composition of the metal, and the temperature of the metal in the ladle.

Obviously, once a provisional value has been chosen for the casting speed per line (m/min) there will be a corresponding value for the duration of the teeming (min), also given by the computer.

Similarly, if a provisional value has been obtained for the total quantities of water to be used in the secondary cooling circuit, i.e. the secondary water supply per zone (l/min), there is a corresponding specific spraying figure per line (l/kg), which the computer likewise supplies at the same time.

It will be appreciated that such control takes into account the perturbations that may occur during casting, such as a decrease in the supply of steel due to a blockage of the teeming nozzles.

Furthermore, the actuation of the positioning of the secondary cooling water valves is preferably effected automatically by subordinating the control of the valves to a signal emitted by the computer.

Also, in addition to the provisional calculations of the casting speed per line and of the secondary water supply per zone, a calculation may be made for adjusting these quantities, for instance, on the basis of the following supplementary data: the temperature of the metal in the tundish, the number of lines in service, and the time of arrival of the next ladle.

The computer program will, clearly, also be adapted to continuously inform the operator on the state of progress of casting; for instance, from the measurement of the casting speed the computer may give the weight of the steel that has been cast and the required time for terminating casting.

So far as the automatic control is concerned wherein requirements are set on a representative output value of the process and the observance of these requirements is ensured by the action of an input value that is unequivocally connected with and reproducible from the aforesaid output value, this control is characterized in that the output value is given by the surface temperature of the product in the process of solidification, in that the input or action value consists of the total quantities of water that are to be used in the secondary cooling circuit, and in that the requirements consist in maintaining a predetermined surface thermal profile.

The surface thermal profile that is to be maintained should aim at avoiding excessive recalescence (increase in temperature due to the latent heat) in passing from one cooling zone to the next; the maximum permissible recalescence depends on the structure and composition of the metal and is preferably less than 100° C.

Contrary to the current practice in continuous casting, it has surprisingly been found that it is necessary to drastically reduce the specific flow rate of water used in the secondary cooling circuit (litres of water per kilogramme of cast metal) as the speed of casting increases. Unless such regulation is appropriately carried out, internal and surface defects are found to appear more and more often.

Thus there is a relationship which depends on the characteristics of the installation and of the metal and must be determined again each time the one or the other of these factors is changed.

The invention will be described further, by way of example only, with reference to the accompanying drawings, in which.

Figure 1:
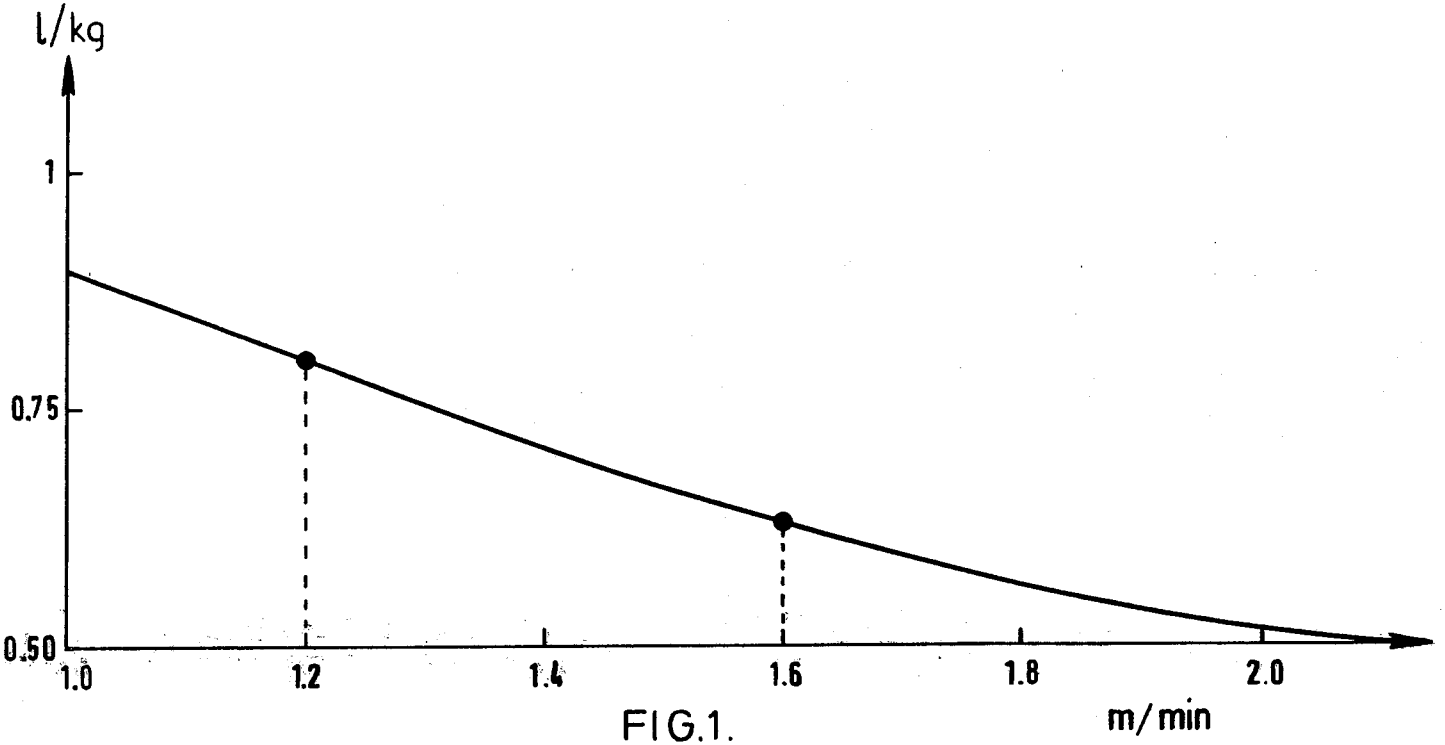
FIG. 1 is a graph of specific flow rate of secondary cooling water (l/kg) against casting speed (m/min) for a given casting machine steel cast.

The relationship which exists between the casting speed and the specific flow rate of secondary cooling water is shown in FIG. 1. In this graph the specific (total) flow rate of secondary cooling water (in l/kg) is plotted as the oridinates and the casting speed of the metal (in m/min) is plotted as the abscissae. It will be understood that this relationship applies only to the particular installation used and the particular steel cast, taken as examples.

It must be observed that the conditions prevailing in the course of the secondary cooling of a continuous casting line are very unfavourable for measuring the surface temperature of the product, especially by reason of the presence of great quantities of water vapour.

According to an operational variant of the invention, a portion of the strand is marked by an indelible imprint at the moment when the surface temperature measuring instrument (e.g. a pyrometer) registers abrupt and recurrent fluctuations of temperatures, which allows identification of this portion at this exit of the continuous casting line. The abrupt and recurrent fluctuations indicate that this portion is liable to be defective.

Figure 2:
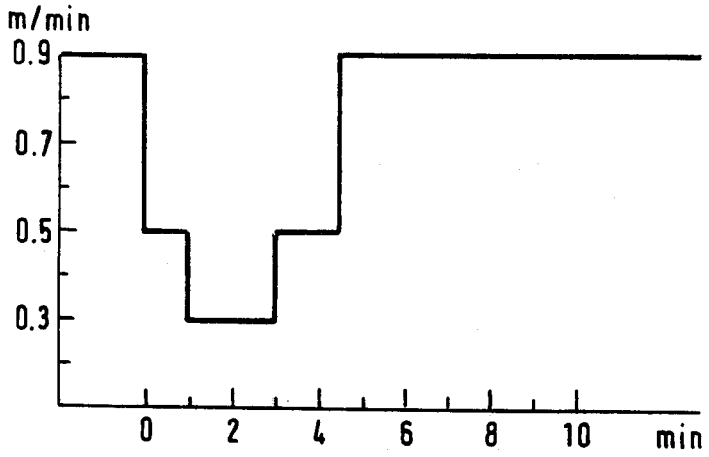
FIG. 2 is a graph of casting speed (m/min) against time (min)

FIG. 2 of the accompanying drawings shows the development of the casting speed (ordinates, m/min) as a function of time (abscissae, min).

Figure 3:
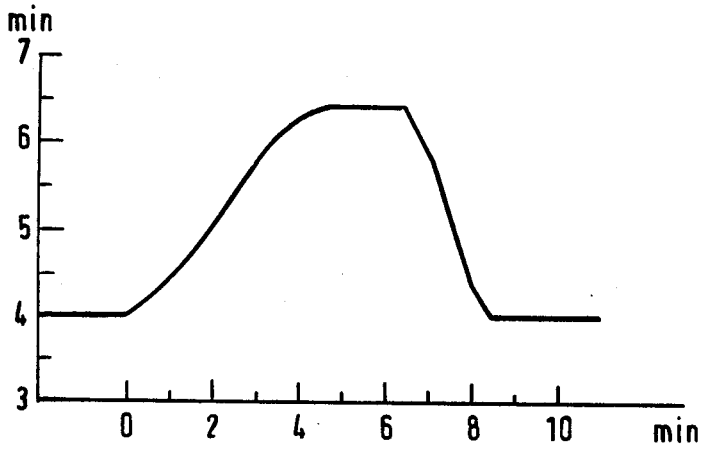
FIG. 3 is a graph of time of passage of a sector of the strand (min) against time (min)

FIG. 3 shows the time of sojourn (ordinates, min) of a sector of metal from its entering the casting machine to the point of exit from secondary cooling zone No. 4 which point lies 3.58 m downstream of the meniscus in the continuous casting mould, this parameter being given as a function of time (abscissae, min).

Figure 4:
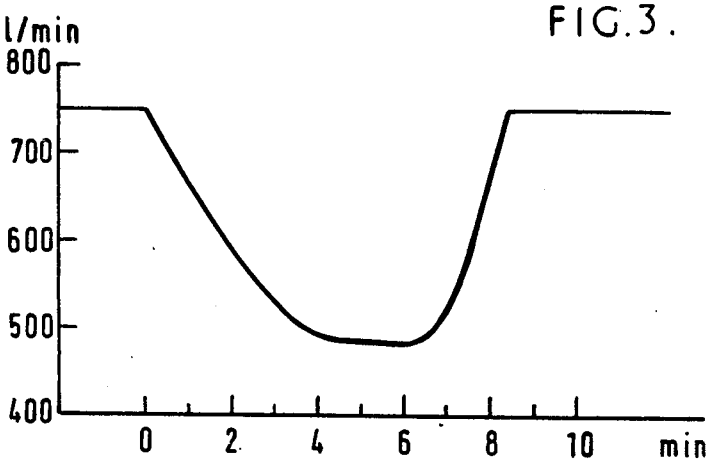
FIG. 4 is a graph of the rate of supply of water (l/min) to a given secondary cooling zone against time (min).

FIG. 4 shows the rate of delivery of wter to the zone No. 4 (ordinates, l/min) as a function of time (abscissae, min).

These three graphs illustrate the case of the operation of changing the ladle, which is shown as having begun at time zer. As a result of the necessity to change the casting ladle, the casting speed was modified as shown in FIG. 2.

The continuous casting machine used was a machine producing 1200 mm X 250 mm slabs of mild steel. The casting speed was chosen at 0.9 m/min, 80 tons converted to be teemed in 40 minutes, which was the duration of the operating cycle of the converter. It is thus seen that the principle of synchronization of the operation of casting and processing was observed.

The machine yielded a straight strand with a liquid core of a maximum length of 23.50 m which allows a maximum casting speed of 1 m/min.

A thermal profile was chosen giving a temperature of 900° C at the exit of each of the secondary cooling zones. By means of previously compiled tables it was found that this thermal profile necessitates a spraying intensity of 0.8 liters/kg. The continuous casting machine was, therefore, started with the following conditions, which remained valid for the steady operation:

Casting speed : 0.9 m/min
Water Supply in Zone No.4: 750 liters/min
Time of Sojourn up to Zone No. 4: 3.98 min.

During the change of the ladle it will be seen that as a result of changes in the casting speed (FIG. 2) a time-variable intensity of spraying was introduced, as shown in FIG. 4. These different values of the supply of secondary cooling water prevented such defects as cracks, fissures, and black lines, that might have arisen if the total water supply rate had been varied in proportion to the casting speed as has hitherto been assumed correct.

The changes in water delivery shown in FIG. 4 arise from converting the casting speed into the time of sojourn of a sector of metal from its entering the casting machine to the point of exit from the zone 4 of secondary cooling, the variations in this time of sojourn being shown in FIG. 3.

Once the exchange of ladles has ended, the conditions revert to the steady operation as mentioned above.

I claim:

1. A method of controlling the continuous casting of a metal by a continuous casting machine having a liquid-cooled mould in which primary cooling of the molten metal occurs to form a metal strand having a liquid core, issuing from the mould, and passing through a series of secondary cooling zones to which a coolant is supplied through respective flow-control valves, the method comprising the steps of: starting the casting machine at an optimum casting speed; measuring the casting speed, which will vary owing to changes in the rate at which molten metal enters the mould; measuring the surface temperature of the strand in each of the secondary cooling zones; from the measured temperatures and the measured casting speed, determining by means of a computer the time taken by a sector of the metal to pass from its entry into the casting machine to its exit from each of the secondary cooling zones and a specific coolant flow rate at which the coolant is to be supplied to each of the secondary cooling zones in order to maintain a desired thermal profile along the strand at the measured casting speed; and controlling the valves so that the coolant is supplied to each of the secondary cooling zones at the rate determined for that zone, the specific coolant flow rate being reduced as the measured casting speed increases.

2. The method as claimed in claim 1, in which the optimum casting speed is determined by the computer calculating the desired casting speed and calculating the maximum casting speed so as to satisfy the quality requirements based on a maximum length of the liquid core in order to avoid defects taking into account the desired thermal profile to prevent defects, and adopting the slower of these two casting speeds as the optimum casting speed.

3. The method as claimed in claim 1, in which the optimum casting speed is determined by the computer by feeding to the computer specific casting data for each ladle of molten metal, the data comprising the weight of the metal in the ladle, the desired casting time, the number of lines in service, the shape of the cross section of the strand in each line, the composition of the metal, and the temperature of the metal in the ladle.

4. The method a claimed in claim 1, in which the valves are controlled automatically in response to a signal emitted by the computer.

5. The method as claimed in claim 1, further comprising adjusting the casting speed for each line and the rate of delivery of coolant for each zone by making calculations by feeding to the computer supplementary data comprising the temperature of the metal in the tundish, the number of lines in service, and the time of arrival of the next ladle.

6. The method as claimed in claim 1, further compising marking the strand at a location where the surface temperature undergoes abrupt and recurrent variations.

* * * * *